US005309584A

United States Patent [19]

Parker

[11] Patent Number: 5,309,584

[45] Date of Patent: May 10, 1994

[54] INVALID HOISTS

[76] Inventor: Roy Parker, Slades Cottage, Adlams Lane, Sway, Hampshire SO41 6EG, United Kingdom

[21] Appl. No.: 991,977

[22] Filed: Dec. 17, 1992

[30] Foreign Application Priority Data

Dec. 17, 1991 [GB] United Kingdom ..... 9126689

[51] Int. Cl.[5] ..... A61G 7/10

[52] U.S. Cl. ..... 5/81.1; 5/86.1; 5/87.1

[58] Field of Search ..... 5/81.1, 83.1, 86.1, 5/87.1, 89.1

[56] References Cited

U.S. PATENT DOCUMENTS

| | | | |
|---|---|---|---|
| 3,277,502 | 10/1966 | Wauthier | 5/81.1 |
| 3,629,880 | 12/1971 | van Rhyn | 5/83.1 |
| 4,682,377 | 7/1987 | Reich | 5/83.1 |
| 4,712,257 | 12/1987 | James | 5/83.1 |
| 4,918,771 | 4/1990 | James | 5/81.1 |

FOREIGN PATENT DOCUMENTS

| | | | |
|---|---|---|---|
| 9006762.2 | 10/1990 | Fed. Rep. of Germany . | |
| 2223477 | 4/1990 | United Kingdom | 5/83.1 |
| 92/04003 | 3/1992 | World Int. Prop. O. . | |

*Primary Examiner*—Michael F. Trettel
*Attorney, Agent, or Firm*—Bacon & Thomas

[57] ABSTRACT

An invalid hoist comprises a pivoted jib (3) for carrying an under arm-sling (13), which is arranged when pivoted to lift a user from a sitting position to a standing position and vice versa. The hoist includes knee engaging means (5) and is preferably mounted on a movable chassis (1). The arrangement is such that the movement of the user's upper body from a sitting position to a standing position always involves a substantial forward component. In preferred embodiments, this is achieved by locating the pivot (15) at substantially the level of a user's waist, by having a jib (3) which is at least twice the length of the distance between the knee joint and the hip joint, and by spacing the pivot (15) backwardly from the knee engaging means (5).

17 Claims, 3 Drawing Sheets

INVALID HOISTS

BACKGROUND OF THE INVENTION

This invention relates to invalid hoists for use in lifting elderly or infirm people, hereafter referred to as users, from a sitting position to a substantially standing position, and vice versa.

Such hoists are known whose major operating component is a lifting jib which pivots in a vertical plane and carries a sling which is placed under the user's arms and around his back to lift or lower him by operating the jib. Knee engaging means is also provided against which the user's knees or upper shins are intended to engage whilst he is being lifted or lowered, so as to assist in controlling the path of movement of his body.

One disadvantage of these known hoists is that the path through which a user's upper body moves between sitting and standing positions tends to be very different from that followed by a user performing such a movement of his own volition, in particular in that at least the first part of such movement is substantially straight up vertically, rather than involving a substantial degree of forward movement of the upper body as is natural. This results in a vertical force equivalent to substantially the whole weight of the user's body being applied under the arms, and this can easily cause the arms to be lifted and the user to slide out of the sling unless he is able to employ substantial muscle power to stop this happening, specifically by lying back into the sling and firmly gripping the end region of the jib with his hands, and clearly there are many potential users who are not capable of doing this. Furthermore the application of a substantially vertical lift tends to lead to uncontrolled rotation of the user's body about the vertical during the initial, substantially vertical, part of the movement, because at that time little or no pressure is exerted by the user's body against the knee engaging means.

SUMMARY OF THE INVENTION

Viewed from one aspect the present invention provides an invalid hoist comprising a pivoted jib for carrying an under-arm sling for a user and arranged, when pivoted, to lift a user from a sitting position to a substantially standing position, and vice versa, and also including knee engaging means, wherein the said jib is so arranged that, in use, the movement of a user's upper body from said sitting to said standing position always involves a substantial forward component.

With such an arrangement, firstly the path of movement of the upper part of the user's body is much more similar to a natural movement between sitting and standing than has been the case with previous proposals, and secondly the continual forward component of such movement between sitting and standing ensures a continued pressure of the user's body on the knee engaging means so as reliably to control such path of movement and, in particular, to prevent rotation of the user's body about the vertical.

In a preferred embodiment of the invention the above effect is achieved by locating the pivot of the lifting jib at a substantially lower level than has been the case in previous proposals, preferably at substantially the same level as the waist of a seated user, so that when the jib pivots the path of movement of its outer end region, where the said sling will be suspended, is much flatter, i.e. much nearer to a horizontal movement, than has been the case in the past. Preferably the height of the pivot of the lifting jib above a support means for the user's feet is less than twice the height of the top of the knee engaging means above said support means, for example in some embodiments the height of the top of the knee engaging means corresponds to at least two thirds of the height of said pivot. In a preferred arrangement the top of the knee engaging means is at a height corresponding to about three quarters of the height of said pivot above said foot support means. In a preferred arrangement the pivot of the lifting jib is located about 0.15 m above the top of the knee engaging means. Preferably the pivot is located about 0.55 m above a means for supporting the feet of a user eg. a footplate.

Of course, lowering the pivot in this way makes it necessary to make the jib longer than hitherto so as to make it capable of lifting a user to a standing position, and in a preferred embodiment the length of the jib between its pivotal axis and the sling attachment region is at least twice the distance between the knee joint and the hip joint of a typical user.

A further advantage of having a longer length between the pivot of the jib and the sling attachment region than has been used hitherto, is that the sling attachment region moves through a relatively shallow arc when the jib is operated, which results in the upper body of the user following a straighter path which is closer to a natural path of movement. In a preferred arrangement the pivot of the jib is also spaced backwardly from the knee engaging means by a greater distance than hitherto so as to accommodate a longer jib. In one arrangement with the jib in its lowest position, a vertical plane containing the said knee engaging means is substantially mid-way between a vertical plane containing the pivotal axis of the jib and a vertical plane containing a sling attachment region of the jib.

Preferably the lifting jib and the knee engaging means are mounted on a mobile chassis, and in a particularly preferred embodiment the chassis is also provided with means for supporting the feet of a user, so that when raised from a seated to a substantially standing position the user is wholly supported on the chassis through the feet support means and the sling. This allows a user to be raised and, once supported on the chassis, moved by a helper to a new location and lowered again into a seated position at the new location.

In such an arrangement the jib is preferably pivotally mounted to an upper end region of a column which is fixed to the chassis, and in the preferred arrangement discussed above wherein the pivot is spaced backwardly from the user, the column may be backwardly inclined. The knee engaging means may then be mounted on a separate substantially vertical or forwardly inclined member, and the feet supporting means may comprise a footplate located vertically below the knee engaging means.

The jib is preferably moved about its pivot by means of a ram which is pivotally connected to the jib at one end and to the chassis at its other end, and which may be a manually operated hydraulic ram, or more preferably an electrically operated ram. A motor and batteries for an electrically operated ram may also be mounted on the chassis.

In a particularly preferred arrangement, the support column for the jib, the knee engaging means and its support, and any motor and batteries for the ram are comprised in a single unit which can be conveniently bolted or otherwise fixed to the chassis. The lower end of the ram may then be pivotally connected to such a unit.

One or more attachment points may be provided at an outer end region of the jib for attachment of a sling. In a preferred embodiment an outer end portion of the jib has two laterally spaced arms each provided with one or more sling attachment points. This provides a particularly stable means of supporting a sling which is placed under the arms and around the back of a user, and furthermore the spaced arms are also convenient for a user to grip if he is able, which may increase his stability and comfort.

It may be advantageous in some applications to use a sling which has a further portion attached to the under arm portion, which can be placed under the thighs of the user to provide additional support, or alternatively, to provide a second sling which can be placed under his thighs. One or more additional attachment points for a second sling or a portion of a sling intended to support a user under the thighs are preferably provided on the jib, spaced below the attachment points for an under arm portion of a sling.

Preferably handles are provided on the jib or its support column which are intended to be used by a helper when manoeuvring the chassis, and which may conveniently be located at substantially the average height of a helpers' waist. The inner end of the jib may have a portion which is angled with respect to a central portion of the jib so as to provide for a more convenient location of such handles on the jib and so as to reduce the variation in height of the handles over a range of operating positions of the jib.

An embodiment of the invention will now be described, by way of example only, with reference to the accompanying drawings, wherein:

DETAILED DESCRIPTION

Figure 1:
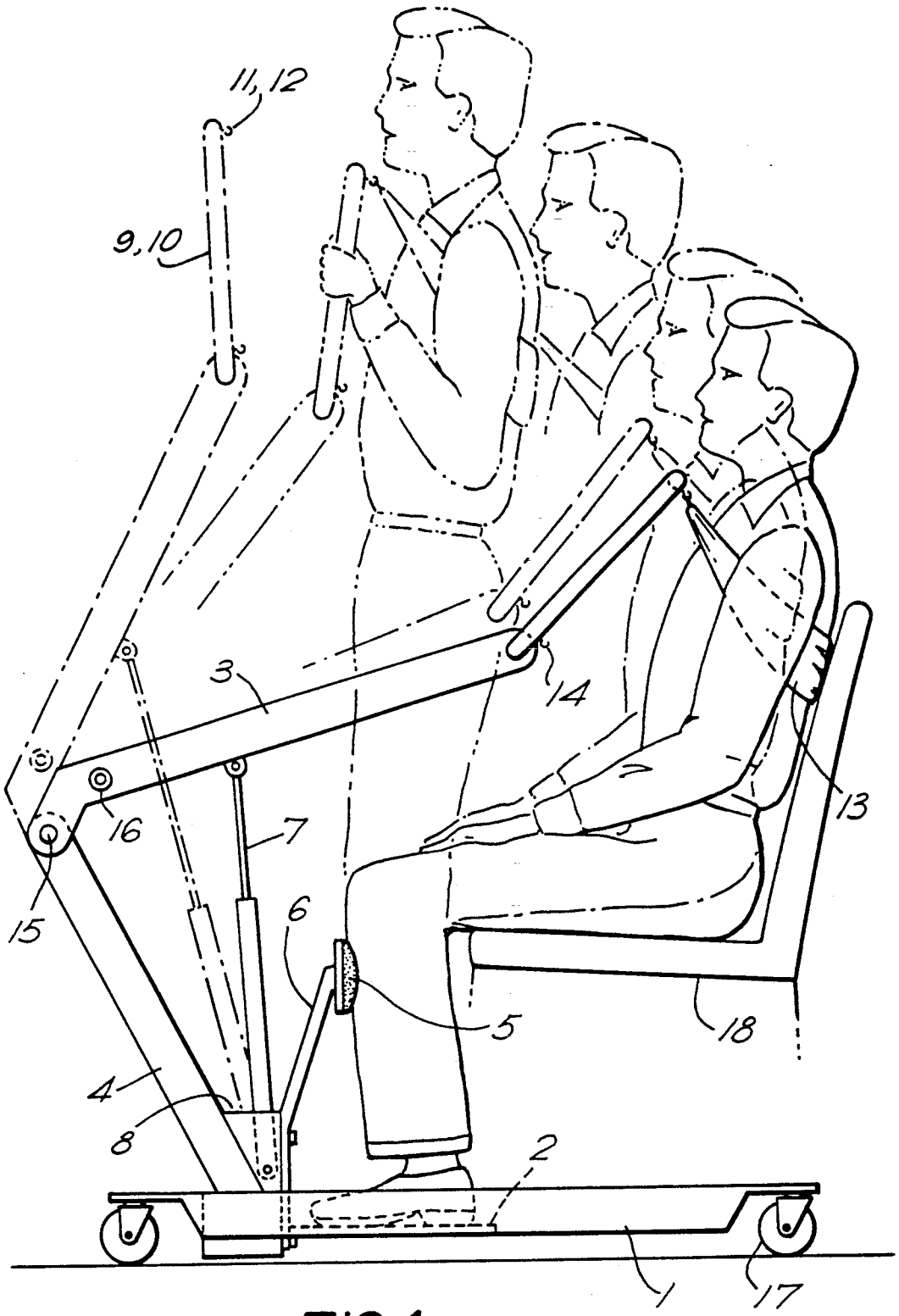
FIG. 1 is a schematic side view of an invalid hoist according to a preferred embodiment of the invention, showing a user in a seated position and in phantom in a substantially standing position and two intermediate positions.

The illustrated embodiment comprises a wheeled chassis 1 having a footplate 2 for supporting a users' feet and a jib 3 pivotally mounted to an upper end of a backwardly inclined column 4. A knee engaging pad 5 is mounted on a forwardly inclined member 6 so as to be located vertically above the footplate 2. An electrically operated ram 7 is pivotally mounted to the jib 3 at an upper end and to the chassis 1 at a lower end. A motor and batteries therefor 8 are located on the chassis 1 between the backwardly inclined column 4 and the knee engaging pad 5. The column 4 supporting the jib 3, the member 6 supporting the knee engaging pad 5 and the motor and batteries 8 form a single unit which is bolted to the chassis, and to which the lower end of the ram 7 is pivotally connected.

The jib 3 is provided at its outer end with two laterally spaced arms 9,10, formed by a substantially U-shaped member fixed to the main body of the jib, which arms have hooks 11,12 at their outer ends providing laterally spaced attachment points for a sling 13 which is placed under the arms and around the back of a user. Two additional attachment hooks 14 are provided on the arms 9,10 at an intermediate location between the jib pivot 15 and the under arm sling attachment points 11,12, from which an additional sling (not shown), or an extension of the under arm sling 13, to be placed under the thighs of the user is optionally suspended. As two laterally spaced hooks 11,12 and two laterally spaced hooks 14 are provided, such a double sling is provided with a particularly stable, four-point, suspension arrangement.

An inner end portion of the jib 3 is angled with respect to the main body portion of the jib so as to provide a convenient location for handles 16 whereby a helper can push the chassis along on its wheels 17 from approximately waist height.

Figure 2:
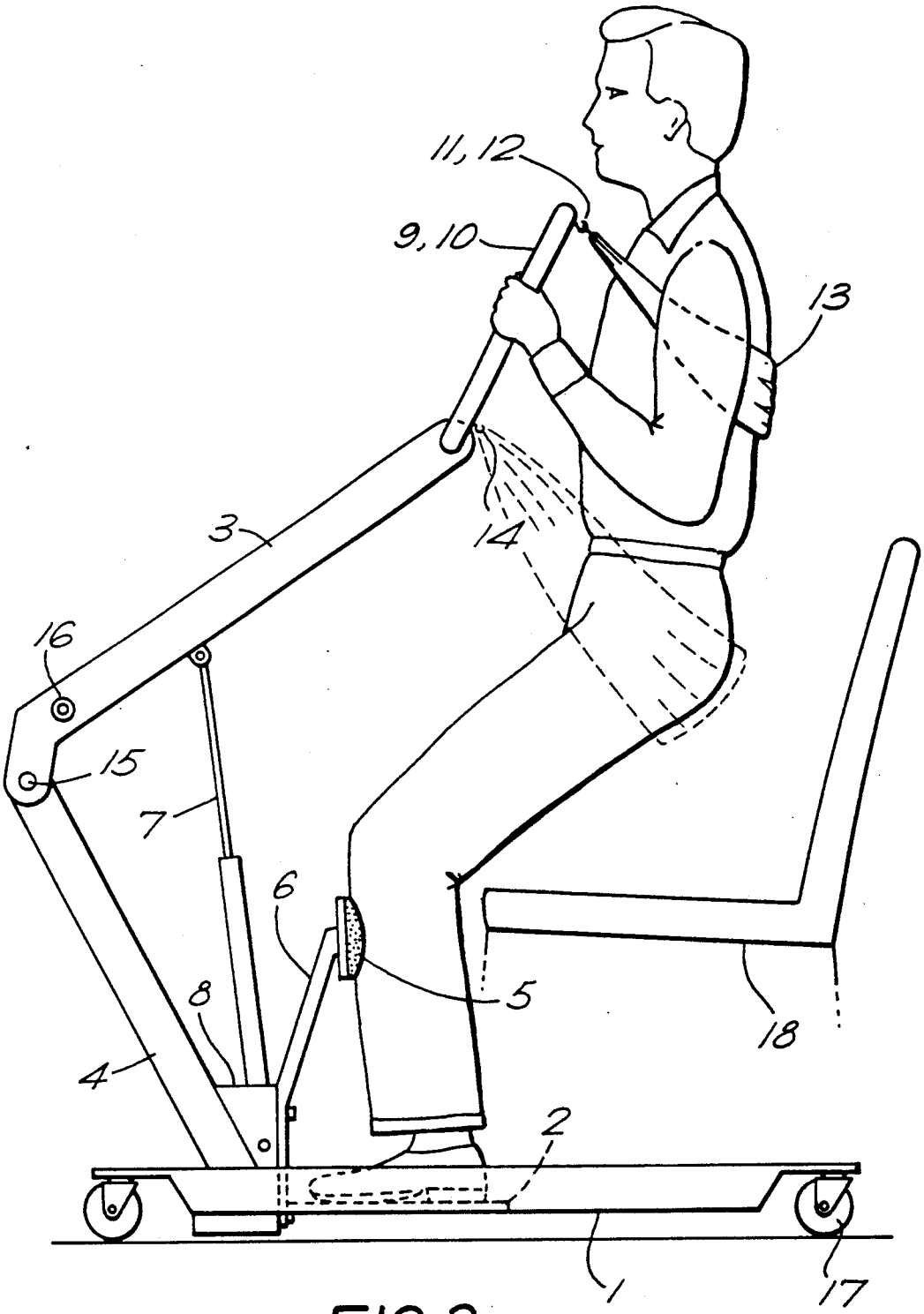
FIG. 2 is a schematic side view of the invalid hoist of FIG. 1 showing a user in a position intermediate a seated and a substantially standing position.

FIG. 1 shows a user in a seated position on a seat 18, with his feet resting on footplate 2 and the front of his knees or upper shins engaging knee support pad 5. The user is also shown in phantom in a substantially standing position with his weight supported on the footplate 2 and under the arms by sling 13, also with the knees pressing against the knee support pad 5, and two further intermediate positions are also partially shown in phantom in FIG. 1. FIG. 2 shows a more detailed view of the user in a position intermediate the seated and substantially standing positions.

In the illustrated embodiment, the height of the pivot 15 corresponds approximately to the waist level of a seated user. The pivot 15 is approximately 0.14 m above the top of the knee support pad 5, which in turn is approximately 0.42 m above the footplate 2. The top of the knee support pad 5 is therefore at a height "a" corresponding to approximately three quarters of the height "b" of the pivot 15 above the footplate 2.

Figure 3:
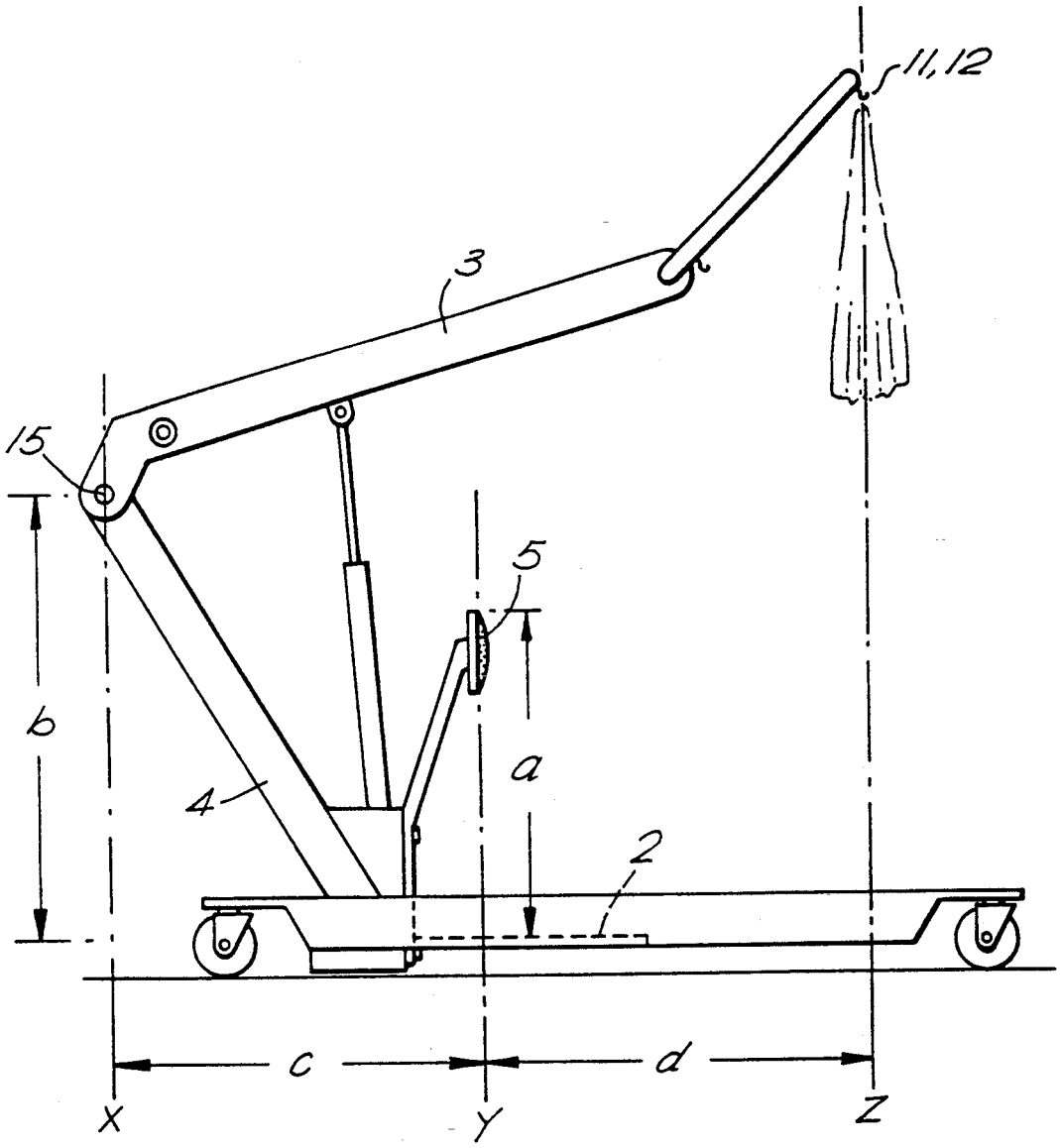
FIG. 3 is a schematic side view of the invalid hoist of FIGS. 1 and 2 showing various dimensions.

Furthermore, as shown in FIG. 3, with the jib 3 in its lowest position, a vertical plane "Y" containing the knee support pad 5 is substantially mid-way between a vertical plane "X" containing the pivotal axis of the jib 3 and a vertical plane "Z" containing the laterally spaced sling attachment points 11,12. That is, the distances "c" and "d" are substantially equal, the pivot 15 being spaced backwardly by a greater distance than hitherto.

In use, when it is desired to raise a user into a standing position, the mobile chassis is wheeled into a position in front of the seated user, whose feet are then placed on the footplate 2 with the front of his knees or upper shins in engagement with the knee support pad 5. The sling 13 is placed under the arms and around the back of the user, and may be tightened if necessary. The ram 7 is then operated so as to move the jib 3 about its pivot. Since the pivot 15 is at a level substantially below the attachment points 11,12 for the sling 13, the attachment points 11,12 follow a path of movement which always has a substantial forward component. Furthermore, since the length of the jib 3 between the pivot 15 and the attachment points 11,12 is relatively long, the attachment points traverse a relatively shallow arc about the pivot 15. The movement of the jib 3 is such that the upper body of the user always has a substantial forward component, as demonstrated by the intermediate positions of a user being raised by the hoist which are illustrated. This is closer to a natural path of movement than is followed by the upper body of a user in known hoists in which the jib pivot 15 is higher and the jib 3 is shorter. Furthermore, because there is a substantial forward component to the path of movement of the users' upper body, his knees are pressed more positively against the knee engaging pads 5 so as to reduce the tendency of the user to rotate in a vertical plane.

If the user is able to hold on to the laterally spaced arms 9,10 then this will provide further stability and is also of psychological comfort to the user. However, because of the increased stability in any case afforded by the substantial forward component of the users' upper body and the consequent pressing of his knees against the support pad 5, it is less important than in hoists known hitherto for the user to grip the jib, and is unnecessary at least in preferred embodiments.

Once the user is raised into a substantially standing position, the chassis 1 may be moved by a helper pushing on handles 16 at substantially waist height. Thereafter, the user may be lowered in the reverse operation at a new location. It will be seen that because of the angled inner end portion of the jib 3 the handles 16 remain at substantially waist height throughout the full illustrated range of movement of the jib 3.

In some applications it may be desirable to provide further support for the user under the thighs, in which case the sling 13 is provided with an additional portion (not shown) which can be placed under the thighs once the user is raised slightly off the seat 18 and hooked up to the additional attachment points 14.

A further feature of the illustrated embodiment is that when the jib 3 is in its lowest illustrated position no part of the hoist is above the eyeline of the user. This has psychological advantages for the user.

I claim:

1. An invalid hoist comprising a pivoted jib (3) for carrying an under-arm sling (13) for engaging the under-arm area of a user and means for pivoting said jib from a lower to a higher position to lift a user via the sling from a sitting position to a substantially standing position, and vice versa; a knee engaging means (5) for engaging the knee area of a user; said jib being mounted for pivotal movement about a pivot (15) that is located at a lower position than the position of engagement of the sling with a user in a sitting position, whereby pivotal movement of the jib from a lower to a higher position to raise a sling and a user always imparts a substantial forward component of motion to the sling and the upper body of a user between a user sitting and a user standing position.

2. An invalid hoist as claimed in claim 1, wherein the pivot (15) of said lifting jib (3) is at substantially the same level as the waist of a seated user.

3. An invalid hoist as claimed in claim 2, including a foot supporting means for a user, and wherein the vertical distance between the pivot (15) of said lifting jib (3) and the foot supporting means is less than twice the vertical distance between the top of said knee engaging mean (5) and said foot support means (2).

4. An invalid hoist as claimed in claim 3, wherein said knee engagement means (5) has top end, and wherein the height of the top end of said knee engaging means (5) above said foot support means (2) corresponds to approximately three quarters of the height of said pivot (15) above said foot support means (2).

5. An invalid hoist as claimed in claim 1, wherein the pivot (15) of said lifting jib (3) is located about 0.15 m above the top of said knee engaging means (2).

6. An invalid hoist as claimed in claim 1, including means (2) for supporting the feet of a user, and wherein the pivot (15) of said lifting jib (3) is located about 0.55 m above said means (2) for supporting the feet of a user.

7. An invalid hoist as claimed in claim 1 wherein said jib includes a sling attachment region (11,12) and wherein the length of said jib (3) between its pivotal axis (15) and the sling attachment region (11, 12) is at least twice the distance between a knee joint and a hip joint of a user.

8. An invalid hoist as claimed in claim 1, wherein said jib includes a sling attachment region (11,12) and wherein, with the jib (3) in its lowest position, a vertical plane (Y) containing the said knee engaging means (5) is substantially mid-way between a vertical plane (X) containing the pivotal axis of the jib (3) and a vertical plane (Z) containing the sling attachment region (11,12) of the jib (3).

9. An invalid hoist as claimed in claim 1, wherein said jib (3) and said knee engaging means (5) are mounted on a mobile chassis (1), which chassis (1) is provided with means (2) for supporting the feet of a user.

10. An invalid hoist as claimed in claim 9, including a column (4) extending generally upwardly from the feet supporting means, and wherein said jib (3) is mounted to an upper end region of said column (4) and including ram means (7) connected between said jib (3) and the base of said column (4).

11. An invalid hoist as claimed in claim 10, wherein said column (4) supporting said jib (3), said knee engaging means (5), and said ram means (7) all form part of a single unit mounted to said chassis (1).

12. An invalid hoist as claimed in claim 1, including a column (4), and wherein said jib (3) is pivotally mounted to an upper end region of said column (4), which column (4) is inclined backwardly, away from said knee engaging means (5).

13. An invalid hoist as claimed in claim 1, wherein said jib (3) is provided with two laterally spaced arms (9,10), each of which arms (9,10) is provided with at least one attachment point (11,12) for the attachment of a sling (13) supporting a user under the arms.

14. An invalid hoist as claimed in claim 13, wherein at least one additional sling attachment point (14) is provided on said jib (3), spaced below said under-arm sling attachment points (11, 12), for supporting a user under the thighs.

15. An invalid hoist as claimed in claim 14, wherein said attachment point comprise two laterally spaced upper attachment points (11, 12) and two laterally spaced lower attachment points (14) for said slings.

16. An invalid hoist as claimed in claim 1, wherein when lowered for securing a sling (13) under the arms of a user in a sitting position, said jib (3) lies wholly below the eye level of a said user.

17. An invalid hoist as claimed in claim 9, wherein the pivot (15) of said lifting jib (3) is located on an angled end portion of said jib (3) and including handles (16) for manoeuvering said chassis (1), said handles being located on a central portion of said jib (3).

* * * * *